United States Patent [19]

Bartczak

[11] Patent Number: 5,056,344

[45] Date of Patent: Oct. 15, 1991

[54] BEZEL

[75] Inventor: Andrzej Bartczak, Newmarket, Canada

[73] Assignee: KTM Locks, Division of Atoma International Inc., Concord, Canada

[21] Appl. No.: 585,523

[22] Filed: Sep. 20, 1990

[51] Int. Cl.[5] ..... E05B 15/02

[52] U.S. Cl. ..... 70/381; 70/452

[58] Field of Search ..... 70/452, 381, 451; 248/27.1

[56] References Cited

U.S. PATENT DOCUMENTS

| | | |
|---|---|---|
| 3,077,101 | 2/1963 | Jacobi . |
| 3,122,013 | 2/1964 | Jacobi . |
| 3,205,712 | 9/1965 | Hoff, Jr. . |
| 3,263,463 | 8/1966 | Duval et al. . |
| 3,400,564 | 9/1968 | Glass et al. . |
| 3,504,551 | 4/1970 | Bohenek . |
| 3,537,322 | 11/1970 | Waite et al. . |
| 3,551,630 | 12/1970 | Griffith . |
| 3,777,522 | 12/1973 | Rubner . |
| 4,006,616 | 2/1977 | Rubner et al. . |
| 4,638,652 | 1/1987 | Morse et al. . |
| 4,702,505 | 10/1987 | Alexander . |
| 4,709,567 | 12/1987 | Appelbaum . |

FOREIGN PATENT DOCUMENTS

| | | | |
|---|---|---|---|
| 967388 | 5/1975 | Canada . | |
| 1019366 | 10/1977 | Canada . | |
| 1235585 | 4/1988 | Canada . | |
| 2056723 | 5/1972 | Fed. Rep. of Germany | 70/381 |
| 3716384 | 11/1988 | Fed. Rep. of Germany . | |
| 2606444 | 5/1988 | France . | |
| 2194582 | 3/1988 | United Kingdom . | |

*Primary Examiner*—Robert L. Wolfe

*Attorney, Agent, or Firm*—Neil H. Hughes; Ivor M. Hughes

[57] ABSTRACT

An insert for a panel opening, the panel having edges disposed therewith proximate the opening, the insert comprising a resilient member having a perimeter and two ends, the member being flexible in a direction transverse to ends of the member when the insert is inserted in the opening, the member having disposed intermediate the ends thereof at least one recess having a bottom, the recess for securing the edges of the panel therewith when the insert is inserted in the opening of the panel, the bottom of the recess being positioned to allow for the lateral movement of the insert in relation to the panel opening transverse to the ends of the member.

67 Claims, 2 Drawing Sheets

BEZEL

FIELD OF THIS INVENTION

This invention relates to bezel structures which surround panel most specifically to those which are used in combination with locking cylinders in the vehicle closure members. Also provided is a method of pre-installing the lock cylinder on the frame on the closure member during the process of manufacture of the closure member. Again the method finds particular application in installations with vehicle closure members such as doors and deck lids.

BACKGROUND OF THE INVENTION

In assembling a closure member for a vehicle normally the frame and the outer panel skin are processed separately and are brought together and assembled on the assembly line. At that point when the two components are assembled, a cylindrical lock is normally installed within the opening through the outer skin or panel and an installer has to somehow connect the operating portions of the cylinder lock with the latch mechanism installed on the vehicle door. Often this installation is a tight fit and quite rigorous and time consuming. It would be advantageous to be able to pre-install the locking cylinder with the latch mechanism with the operating levers attached prior to installation of the outer skin.

In the prior art once the cylindrical lock is inserted in the opening through the panel and attached to the operating levers of the latch mechanism, a bezel surrounding the edges of the opening through the panel is installed to support the end of the locking cylinder through the opening. This end is often threaded and the bezel may be threaded as well or may include supplementary portions which are threaded such as a nut or the like.

Canadian Patent No. 1,019,366 describes a Hardware Assembly which is attached to a panel from the rear thereof with clamping portions. The handle assembly has the key latch lug 35 and operating levers proximate the interior thereof which must be connected to the latch portions of the lock mechanism for the door. This would still be quite a cumbersome task in spite of the module provided.

U.S. Pat. No. 3,077,101 to Jacobi includes a bezel 19 which has an ornamented trim thereon which extends closely to the holes in lugs 18 on the front of the lock housing and overlies the outer face of the outer panel 8 of the rear deck lid and cooperates with nut 15 to prevent axial displacement of the lock housing. Therefore it is taught generally that the bezel aside from being the dust cover also holds the front of the lock mechanism in place. However this structure does not obviate the concerns expressed above in a relation to an assembly line and the labour involved with installing the prior art structures.

U.S. Pat. No. 3,122,013 to Jacobi teaches a outer bezel portions secured to the front of the locking body.

U.S. Pat. No. 4,006,616 includes a lock body having internal an external weather seal for a cylinder lock. This arrangement is an example of the prior art structures which applicant obviates.

U.S. Pat. No. 3,777,522 describes again a seal or cap for a locking body including an annular bezel on the locking body. This reference again is an example of the teachings in the prior art.

Canadian Patent No. 967,388 is the equivalent to U.S. Pat. No. 3,777,522.

Canadian Patent No. 1,235,585 describes a lock protector for a fuel cap which includes a lock portion extending through the fuel cap which has a cup like body inserted therewith so that the head of the lock is drawn against this and sealed by the body as a lock nut is drawn tight.

U.S. Pat. No. 4,709,567 by Appelbaum describes a lock cover device made of a resilient polymeric material.

French Publication 2,606,444 by Vachette describes an elastic device which presses against the inside external plate of a door.

U.S. Pat. No. 3,400,564 describes a dust cap for tumbler locks, the dust cap having lips which overlap the back of a flange on the lock which may be formed of resilient plastic material as best seen in relation to FIG. 2. However the structure does not include the pre-installation of the locking cylinder on the frame portion of the vehicle door with the dust cap of U.S. Pat. No. 3,400,564 orienting the cylinder when assembled.

U.S. Pat. No. 4,702,505 includes a horizontally adjustable bezel as best seen in FIG. 2 which allows because of the star shaped openings in the bezel plate the lateral motion of the bezel. However the bezel portion does not include an annular recess for engagement of the edges of the panel portion allowing for adjustment in position of the bezel portion.

U.S. Pat. No. 3,263,463 by Duval describes a weather seal in the prior art for locking cylinders illustrating the complexity for locking cylinders.

U.S. Pat. No. 4,638,652 describes a sealing cap for a lock assembly representing the complexity of such an arrangement obviated by the present invention.

Great Britain Patent Application 2,194,582 published on Mar. 9, 1988 describes a lock protection device for automobiles to inhibit freezing up in winter conditions of the lock. The materials used in forming the device is plastic. The device is located near the lock assembly and fastened in position. In one embodiment adhesives are used.

West German Publication No. 3,716,384 by Luipold published on Nov. 24, 1988 teaches a cover which fits over a lock and is held in position by magnets as best observed in relations to FIG. 2. The material used in forming the protective cover may be plastic or metal.

U.S. Pat. No. 3,205,712 by Hoff, U.S. Pat. No. 3,504,551 by Bohenek, U.S. Pat. No. 3,537,322 by Waite each describe a bezel for a gauge, the bezel being made from plastic materials and having flanges formed therewith so as to engage each assembly. The flanges are resilient. These references are presented as examples of other bezels known to applicant.

U.S. Pat. No. 3,551,630 to Griffith Plastic Products Company describes a bezel for surrounding an opening as best seen in relations to FIG. 2, the bezel having an peripheral flange and having a plurality of studs disposed around the bezel and used in combination with a retainer. This example is used for sealing around an electrical panel.

Nowhere within the prior art is there found a bezel which is made from resilient material and which is pre-installed in a panel opening of a panel or skin to be assembled with a frame, the frame including a lock portion extending laterally away from the frame toward the panel in use, the lock portion being pre-installed in the frame and when the frame portion and the panel portion are assembled the lock portion extends through an opening in the panel portion and through the bezel. The bezel includes means to align the axis of the extension to the bezel with the axis of extension of the lock portion and provides a friction fit to fasten the lock portion at that end. None of the prior art allows for the pre-installation of the lock portion with the frame and the bezel in the panel so that each may be processed separately in an assembly line and be assembled with ease and simplicity not requiring that an installer work in very cramped conditions.

It is therefore the primary object of this invention to provide a resilient insert such as a bezel or the like which may be pre-installed in an opening through a panel, preferably the panel to be installed with a frame portion having pre-installed thereon a lock portion extending laterally away from this frame portion toward the outer panel in use, the insert, bezel or the like being moveable laterally in its position in the opening of the panel when the lock portion engages the insert, bezel portion or the like at the time that the framing portion and the panel portion are assembled.

It is further an object of this invention to provide a process for assembling a closure assembly and preferably a vehicle door or deck lid wherein a locking cylinder may be pre-installed in the frame of the closure assembly prior to installation of the panel which includes the bezel portion pre-installed therewith.

Further and other objects of this invention will become apparent to a man skilled in the art when considering the following summary of the invention and the more detailed description of the preferred embodiments thereof illustrated herein.

SUMMARY OF THE INVENTION

According to one aspect of the invention there is provided an insert for a panel opening, the panel having edges disposed therewith proximate the opening, the insert comprising a resilient (preferably thermoplastic) member having a perimeter and two ends, the member being flexible in a direction transverse to ends of the member when the insert is inserted in the opening, the member having disposed intermediate the ends thereof at least one recess having a bottom, preferably the recess extending about the perimeter of the insert, the recess for securing the edges of the panel therewith when the insert is inserted in the opening of the panel, the bottom of the recess being positioned to allow for the lateral movement of the insert in relation to the panel opening transverse to the ends of the member, (preferably to compensate for variations from panel to panel in the dimensions of the opening).

According to another aspect of the invention there is provided a bezel for a panel opening, the panel having edges disposed therewith proximate the opening, the bezel comprising a resilient (preferably thermoplastic) member having a perimeter and two ends, the member being flexible in a direction transverse to ends of the member when the bezel is inserted in the opening, the member having disposed intermediate the ends thereof at least one recess having a bottom, preferably the recess extending about the perimeter of the bezel, the recess for securing the edges of the panel therewith when the bezel is inserted in the opening of the panel, the bottom of the recess being positioned to allow for the lateral movement of the bezel in relation to the panel opening transverse to the ends of the member, (preferably to compensate for variations from panel to panel in the dimensions of the opening).

According to yet another aspect of the invention there is provided a bezel for an opening in a vehicle panel (preferably the outer panel of a vehicle door or trunk lid), the panel having edges disposed therewith proximate the opening, the bezel comprising a resilient (preferably thermoplastic) member having a perimeter and two ends, the member being flexible in a direction transverse to ends of the member when the bezel is inserted in the opening of the panel, preferably the member including flexing portions disposed intermediate the ends of the member to allow the flexing thereof, the member having disposed intermediate the ends thereof at least one recess having a bottom, preferably the recess extending about the perimeter of the bezel, the recess for securing the edges of the panel therewith when the bezel is inserted in the opening of the panel, the bottom of the recess being positioned to allow for the lateral movement of the bezel in relation to the panel opening transverse to the ends of the member. In one embodiment the positioning of the bottom of the recess allows for variations from panel to panel in the dimensions of the opening in the panel.

According to yet another aspect of the invention there is provided a bezel for an opening in a vehicle panel (preferably the outer panel of a vehicle door or trunk lid), the panel having edges disposed therewith proximate the opening, the bezel being installed in the opening of the vehicle panel prior to the panel being installed with a vehicle frame member (preferably a door frame or a trunk lid frame) during the assembly of a vehicle, the vehicle frame member having separately installed therewith a lock portion (preferably cylindrical) extending away from the vehicle frame along an axis of extension and to proximate the opening of the panel in use; the bezel comprising a resilient (preferably thermoplastic) member having two ends, an axis of extension from end to end of the member and a perimeter, (preferably the member being circular in configuration), the member having an opening extending therewith along the axis of extension of the member, the opening being surrounded by a border and for receipt of the lock portion when the panel and the vehicle frame are assembled in use, the member having disposed at one end thereof proximate the border of the opening means to align the axis of extension of the opening of the member with the axis of extension of the lock portion when the lock portion is inserted in the opening of the member during assembly of the panel and the vehicle frame, the member being flexible in a direction transverse to ends of the member when the bezel is inserted in the opening of the panel prior to the installation of the panel with the vehicle frame, preferably the member including flexing portions disposed intermediate the ends of the member to allow the flexing thereof, the member having disposed intermediate the ends thereof at least one recess having a bottom, preferably the recess extending about the perimeter of the bezel, the recess for securing the edges of the panel therewith when the bezel is inserted in the opening of the panel prior to assembly with the vehicle frame, the bottom of the recess being positioned to allow for the lateral movement of the bezel in relation to the panel opening transverse to the ends of the member when during assembly of the panel and the vehicle frame the lock portion is inserted in the opening of the member and the lock portion engages the means to align the axis of extension of the opening with the axis of extension of the lock portion. In one embodiment the means to align the axis of extension of the opening with the axis of extension of the lock portion are tapered surfaces disposed proximate the border of the opening in the member. When the panel and frame are assembled the bezel may move in relation to the lock portion and the lock portion may move in relation to the bezel while still maintaining a friction fit therebetween.

According to a preferred embodiment of the invention the bezel may further comprise tapered portions disposed at on end of the member tapering from proximate the recess towards the end of the member proximate the vehicle frame when assembled, the tapered portions for simplifying the insertion of the member in the opening of the panel until the edges of the opening in the panel are secured in the at least one recess of the member. Preferably the end of the member remote the tapered portions includes an arcuate ring portion extending from proximate the at least one recess to the end of the member remote the tapered portions. In one embodiment the arcuate ring portion has an annular lip disposed proximate the panel in use to provide a weather seal for the lock portion, preferably the lip being biased toward the end of the member wherein the tapered portions are disposed, the lip defining a wall of the at least one recess, the remaining wall of the recess being defined by the terminus of the tapered portion, the walls defining the recess having a bottom and at least the lip of the arcuate ring portion being biased to engage the edges of the panel proximate the opening thereof. In another embodiment the tapered portions of the member are discontinuous and are joined together by flexible webs which enhance the transverse flexibility of the member.

The modern vehicle has convex panels which make up the body thereof. Once the bezel is inserted in a vehicle panel it may distort as a result of the contouring of the vehicle panel proximate the opening in the panel. Therefore the resilience of the bezel is important to the bezels successful use when being inserted in the panel opening as well as when installed. By providing the pre-installation of the bezel with the panel separately from the installation of the lock with the vehicle frame, an ease of assembly is realized especially by providing the self aligning facility of the bezel with the lock portion. Further, the bezel and the lock may move in relation to one another laterally once installed. The lock may also move axially in relation to the bezel without separating therefrom constantly maintaining a friction fit with the bezel.

According to yet another aspect of the invention there is provided a resilient bezel for pre-installation in the opening of a panel of a closure member for a vehicle, the panel having edges disposed therewith proximate the opening, the panel for installation with a frame of a closure member for a vehicle in use, the vehicle closure member frame having disposed therewith a lock portion (preferably cylindrical) extending towards the panel opening in use, the bezel comprising a member having two ends, an interior, a first diameter and a perimeter, the member having an opening extending through the interior of the member, some of the opening being bordered by tapering walls having a second diameter proximate one end of the member and tapering towards the opening terminating intermediate the two ends of the member, the opening thereat extending to the end of the member remote the tapered opening and having a third diameter, the tapering disposed proximate the second diameter providing means to align the axis of extension of the opening of the member with the axis of extension of the lock portion when the lock portion is inserted in the opening of the member during assembly of the panel and the vehicle closure member frame, the member being flexible in a direction transverse to ends of the member when the bezel is inserted in the opening of the panel prior to the installation of the panel with the vehicle closure assembly frame, preferably the member including flexing portions disposed intermediate the ends of the member to allow the flexing thereof, the member having disposed intermediate the ends thereof at least one recess having a bottom, preferably the recess extending about the perimeter of the bezel, the recess for securing the edges of the panel therewith when the bezel is inserted in the opening of the panel prior to assembly with the vehicle closure assembly frame, the bottom of the recess being positioned to allow for the lateral movement of the bezel in relation to the panel opening transverse to the ends of the member when during assembly of the panel and the vehicle frame the lock portion is inserted in the opening of the member and the lock portion engages the means to align the axis of extension of the opening with the axis of extension of the lock portion, whereby upon installation the bezel and lock portion are moveable in relation to one another laterally, and the lock portion is free to move axially in relation to the bezel while maintaining a constant friction fit with the bezel.

According to yet another aspect of the invention there is provided a method of installing a key cylinder lock pre-installed with the frame of a closure assembly (preferably a vehicle door frame) in an opening through an exterior panel of the closure assembly having a bezel installed therein, the bezel being moveable in relation to the opening when the panel is installed with the frame to adjust for manufacturing tolerances in the alignment of the key cylinder lock and the bezel, the bezel comprising a resilient (preferably thermoplastic) member having a perimeter and two ends, the member being flexible in a direction transverse to ends of the member when the bezel is inserted in the opening, the member having disposed intermediate the ends thereof at least one recess having a bottom, preferably the recess extending about the perimeter of the bezel, the recess for securing the edges of the panel therewith when the bezel is inserted in the opening of the panel, the bottom of the recess being positioned to allow for the lateral movement of the bezel in relation to the panel opening transverse to the ends of the member, (preferably to compensate for variations from panel to panel in the dimensions of the opening), the method comprising;

(a) forming a frame for the closure member;
(b) installing the key cylinder lock with the frame oriented laterally away from the frame towards the panel opening in use;
(c) separately forming the exterior panel;
(d) forming an opening through the exterior panel;
(e) installing the bezel in the opening;
(f) installing the exterior panel with the frame.

wherein when the key lock cylinder is installed in the opening, the bezel moves to adjust for any manufacturing tolerances in the alignment of the key cylinder lock and the bezel and whereby upon installation the bezel and lock portion are moveable in relation to one another laterally, and the lock portion is free to move axially in relation to the bezel while maintaining a constant friction fit with the bezel.

According to yet another aspect of the invention there is provided a method of installing a key cylinder lock pre-installed with the frame of a vehicle closure assembly (preferably a vehicle door frame or deck lid) in an opening through an exterior vehicle panel of the closure assembly having a bezel installed therein, the bezel being moveable in relation to the opening when the panel is installed with the frame to adjust for manufacturing tolerances in the alignment of the key cylinder lock and the bezel, the bezel for an opening in a vehicle panel (preferably the outer panel of a vehicle door or trunk lid), the panel having edges disposed therewith proximate the opening, the bezel being installed in the opening of the vehicle panel prior to the panel being installed with a vehicle frame member (preferably a door frame or a deck lid frame) during the assembly of a vehicle, the vehicle frame member having separately installed therewith a key cylinder lock extending away from the vehicle frame along an axis of extension and to proximate the opening of the panel in use, the bezel comprising a resilient (preferably thermoplastic) member having two ends, an axis of extension from end to end of the member and a perimeter, (preferably the member being circular in configuration), the member having an opening extending therewith along the axis of extension of the member, the opening being surrounded by a border and for receipt of the lock portion when the panel and the vehicle frame are assembled in use, the member having disposed at one end thereof proximate the border of the opening means to align the axis of extension of the opening of the member with the axis of the extension of the lock portion when the lock portion is inserted in the opening of the member during assembly of the panel and the vehicle frame, the member being flexible in a direction transverse to ends of the member when the bezel is inserted in the opening of the panel prior to the installation of the panel with the vehicle frame, preferably the member including flexing portions disposed intermediate the ends of the member to allow the flexing thereof, the member having disposed intermediate the ends thereof at least one recess having a bottom, preferably the recess extending about the perimeter of the bezel, the recess for securing the edges of the panel therewith when the bezel is inserted in the opening of the panel prior to assembly with the vehicle frame, the bottom of the recess being positioned to allow for the lateral movement of the bezel in relation to the panel opening transverse to the ends of the member when during assembly of the panel and the vehicle frame the lock portion is inserted in the opening of the member and the lock portion engages the means to align the axis of extension of the opening with the axis of extension of the lock portion. In one embodiment the means to align the axis of extension of the opening with the axis of extension of the lock portion are tapered surfaces disposed proximate the border of the opening in the member, the method comprising;

(a) forming a frame for the closure member;
(b) installing the key cylinder lock with the frame oriented laterally away from the frame towards the panel opening in use;
(c) separately forming the exterior panel;
(d) forming an opening through the exterior panel;
(e) installing the bezel in the opening;
(f) installing the exterior panel with the frame.

wherein when the key lock cylinder is installed in the opening, the bezel moves to adjust for any manufacturing tolerances in the alignment of the key cylinder lock and the bezel, whereby upon installation the bezel and lock portion are moveable in relation to one another laterally, and the lock portion is free to move axially in relation to the bezel while maintaining a constant friction fit with the bezel.

In pursuing the method of installation a great advantage is realized over the prior art. The key cylinder may be pre-installed with the frame of the vehicle door and all of the connections made to the appropriate latching structure without the skin being in position to interfere with the installers freedom. Typically the prior art structures require installation of the lock after the exterior panel with the opening is installed on the frame. The connections by the installer are very difficult with these prior art structures. The instant method obviates this problem.

BRIEF DESCRIPTION OF THE DRAWINGS

The invention will now be illustrated with respect to the following drawings illustrating embodiments of the invention in which.

DETAILED DESCRIPTION OF PREFERRED EMBODIMENTS OF THE INVENTION

Figure 1:
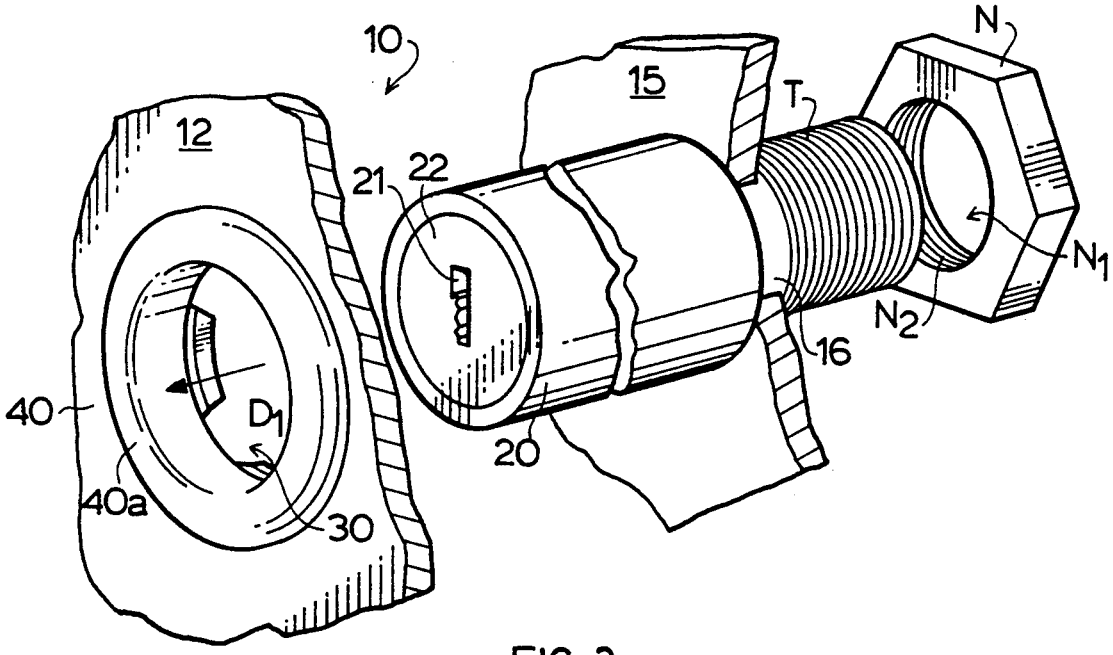
FIG. 1 is an exploded cutaway perspective view of a lock cylinder on a vehicle door frame which is to be inserted within the opening surrounded by the bezel illustrated in a preferred embodiment of the invention.

Referring to FIG. 1 there is illustrated a key cylinder assembly 10 including a key cylinder 20 being fastened to the frame 15 of a vehicle door or deck lid through an opening 16 of the frame 15 illustrated in simplistic terms and being fastening at the end of the cylinder having the thread, threaded portion T by a nut N having an opening N1 therein the portion of nut N surrounding the opening N1 is threaded at N2. The key cylinder 20 has a front 22 wherein is disposed a key slot 21 as is well known. Of course the key cylinder may be attached to the frame in any other manner as is required. The importance of the assembly is that the key cylinder is pre-installed with the vehicle frame. It is not required with the instant invention to leave the key cylinder and its installation to following the installation of the outer skin of the door or deck lid with its frame. Therefore the key cylinder of FIG. 1 may have its operating linkages (not illustrated) connected to the appropriate latch mechanism in order to actually connect the latch mechanism by an installer in a much more simplified fashion without the need to work in tight spaces once the skin is installed on the frame. In the prior art this has been the case creating a very difficult installation on the assembly line. Once the key cylinder 20 is installed on the frame and the operating portions of the key cylinder are attached to a latch mechanism the outer panel 12 to be assembled with the frame 15 may be installed. Bezel 40 is installed within an opening 30 in the panel 12. The bezel has an outer ring 40A acting as both a moisture and a dust seal the use of which will be described here and after.

Figure 1A:
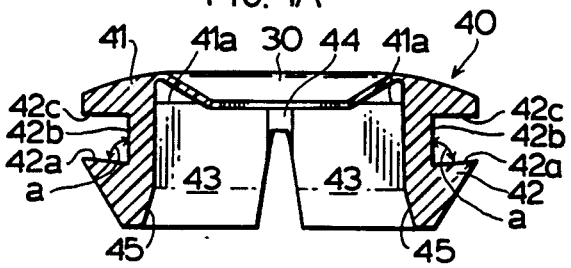
FIG. 1A is a cross section view of the bezel of FIG. 1.

Referring now to FIG. 1A there is illustrated the bezel 40 of FIG. 1 in cross section to describe the details of the construction thereof. Of course the bezel has the opening 30 extending there through. The bezel is generally formed in a ring having an outer diameter and an inner diameter. The inner diameter of the ring forming the opening 30 and the outer diameter forming the other features of the bezel. The bezel 40 has disposed on its outer diameter and annular groove 31 extending around the perimeter of the bezel 40. The groove has a bottom **42*b* and two sides 42*a* and 42*c*. As illustrated in FIG. 1A the side of the groove of 42*a* is disposed at an angle a which is not horizontal. Of course the side 42*c* may be disposed at a predetermined angle to the horizontal as well. Lips 41 and 42 border the groove, which lips have a predetermined cross section and are resilient so that when the bezel is inserted within the opening the edges of the panel 12 around the opening 30 enter into the annular recess 31 which because of the resilient lips 41 and 42 the edges of the panel 12 are pressed at the sides 42*a* and 42*c* of the annular groove 31 to assist in fixing the bezel in position yet leaving it unfastened to any member other than the annular groove abutting the edges of the panel 12**.

Figure 4:
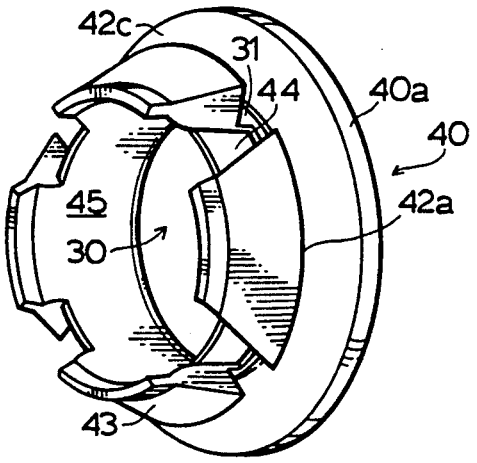
FIG. 4 is a perspective view of the bezel of FIG. 1 illustrated in the preferred embodiment of the invention.
Figure 5:
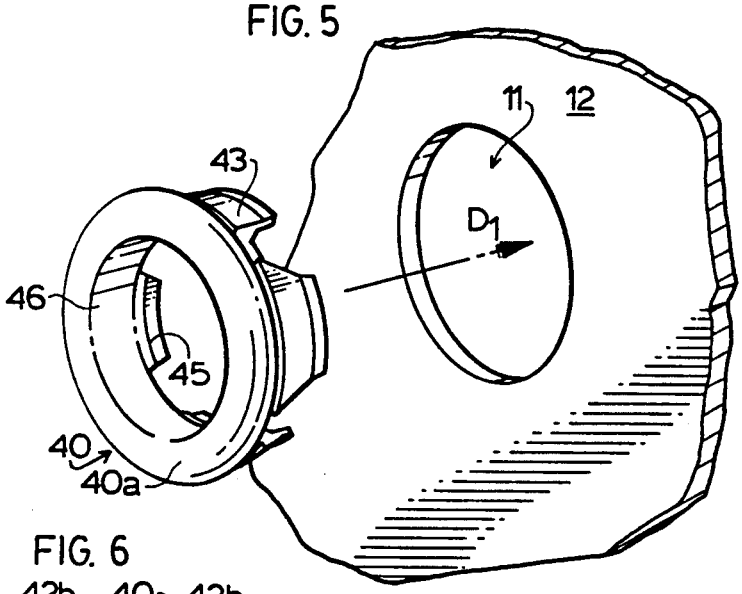
FIG. 5 is a perspective view of a bezel being inserted within a panel opening illustrated in a preferred embodiment of the invention.

Flexing portions 43 as best seen in relation to FIG. 4 are provided to allow for the easy insertion of the bezel 40 within the opening 30. The tapering of the outer walls of the flexing portions 43 allows for the flexing which is further enhanced by the flexible webs 44 interconnecting each tapered member 43 which readily assists in the insertion of the bezel in an opening of a predetermined diameter in the panel 12. The size of these webs and the angle of their cut b as best seen in FIG. 4 depends on the diameter of the hole in which the bezel is being inserted. The web portion 44 are deep cut in order to enhance the flexibility.

Disposed within the inner diameter of the bezel 40 are tapered portion 45 formed on the under side of the flexible portion 43 which allow alignment of the axis of extension of the cylinder 20 with the axis of extension of the bezel 40. This feature will be described here and after. Located at the other end of the opening 30 through the bezel are sealing portions **41*a* which are optional and may or may not be provided in the bezel structure. These sealing flanges 41*a* assist in the sealing of the face 22 of the key cylinder 20 as best seen in FIG. 1**.

Figure 2:
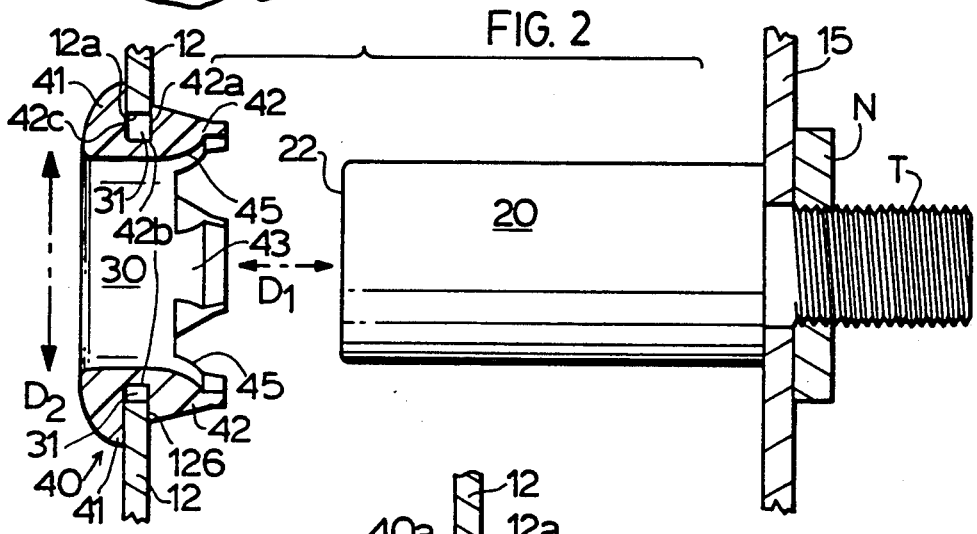
FIG. 2 is a cross section view of the structure of FIG. 1 illustrated in a preferred embodiment of the invention.
Figure 3:
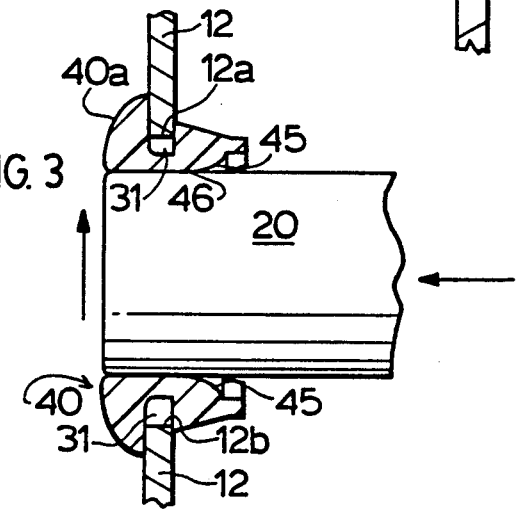
FIG. 3 is a cross section view similar to FIG. 2 but showing the key cylinder inserted within the bezel surrounding the opening illustrated in a preferred embodiment of the invention.

Referring now to FIGS. 2, 3, 5, 6, and 7 there is illustrated the key cylinder 20 affixed to the frame 15 by the nut N and the thread T located at the one end of the cylinder 20. The other end of the cylinder has face 22 which is through an exterior panel of the closure assembly having a bezel extending along an axis D1. The cylinder 20 has been pre-installed on the vehicle frame and the skin 12 is now being assembled onto the vehicle frame. In assembling the skin 12 having the opening 30 there through onto the vehicle frame the bezel 40 engages the cylinder 22 proximate the face 22 at the outer diameter thereof at the tapered edges 45 on the interior diameter of the bezel 40. As the cylinder is inserted and abuts the taper 35 with the bezel 40 the bezel will move within the limits of its capability usually about 3.2–3.5 mm to compensate for any misalignment with the axis of extension of the cylinder 20, of the axis of extension of the bezel 40. Therefore the arcuate groove 31 of the bezel abuts the edges of the panel 12 adjacent of the opening 30. However there remains a space within the arcuate groove 31 surrounding the entire bezel which allows the bezel to move in relation to the edges of the panel 12 in any direction until the cylinder comes to rest as best illustrated in FIG. 3 where in the bezel has moved in an upward direction in relation to the drawing in order to align itself properly with the axis of extension of the cylinder 20. Therefore the edge of the panel **12*a* is closer to the bottom of 42*b* of the annular groove 31 in FIG. 3 then it is as illustrated in FIG. 2. This is because the bezel has moved upwardly toward the edge 12*a* placing the bottom 42*b* closer to that edge and farther from that edge 12*b***. Once installed in the bezel the cylinder is held by a friction fit, yet still free to move axially about 5 mm to compensate for any movement due to temperature changes or the like. This action allows the door to appear quite normal to the operator and prevents buckling around the bezel if as in the prior art it were fixed in position. This advantage is particularly evident for plastic doors.

Referring now again to FIGS. 4, 5, 6, and 7 there is illustrated the design of the bezel 40 which enhances its ability to be resilient. Not only is the bezel manufactured from resilient materials such as plastic but it is contoured in shape to describe predetermined angles such as angle b which describes the angle of the disposition of the tapered walls of tapered portions 43 adjacent the flexible web portion 44. All of the angles of the bezel are variable depending on the geometry of the door or deck lid and the cylinder forming the lock portion.

Figure 6:
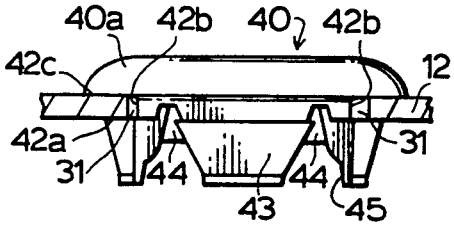
FIGS. 6 and 7 are cross section views of the bezel of FIG. 4 describing the resiliency thereof and illustrated in a preferred embodiment of the invention.

For example if the outer skin of the door is made from plastics as is more and more prevalent, then the bezel and its resilience becomes more important. For plastic doors the bezel must be capable of flexing because of the contoured shapes of the outer plastic skin 12 of the door. The bezel therefore must be resilient and be capable of forming a convex shape once installed in the opening of a plastic panel. FIG. 6 illustrates the installation of the bezel in a standard more planer outer door skin 12. It may be appreciated in relation to the description of FIGS. 2 and 3 that as the temperature changes the bezel and the cylinder are capable of moving, the bezel being not fastened to the skin of the door or to the cylinder to any extent whatsoever.

Therefore the cylinder may move laterally or axially in relation to the bezel and still be retained in friction fit engagement with the bezel. This situation may occur because of temperature changes during the heat of the day or the cool of the evening.

Figure 7:
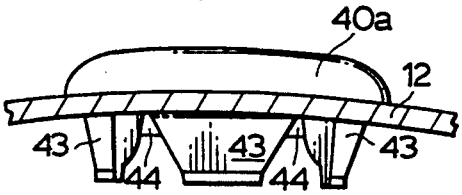

As is clearly seen in relation to FIGS. 6 and 7 the outer annular ring **40*a* of the bezel 40 provides a ceiling surface at 42*c* of the panel edges 12*a* and 12*b*** to prevent moisture or dust from entering into the cylinder and damaging the operation thereof.

As many changes can be made to the preferred embodiments of the invention without departing from the scope thereof; it is intended that all matter contained herein be considered illustrative of the invention and not in an illuminating sense.

I claim:

1. An insert for a panel opening, the panel having edges disposed therewith proximate the opening, the insert comprising a resilient member having a perimeter and two ends, the member being flexible in a direction transverse to the ends of the member when the insert is inserted in the opening, the member having disposed intermediate the ends thereof at least one recess having a bottom, the recess for securing the edges of the panel therewith when the insert is inserted in the opening of the panel, the bottom of the recess being positioned to allow for the lateral movement of the insert in relation to the panel opening transverse to the ends of the member.

2. The insert of claim 1 wherein the resilient member is made from thermoplastic materials.

3. The insert of claim 1 or 2 wherein at least one recess extends about the perimeter of the insert.

4. A bezel for a panel opening, the panel having edges disposed therewith proximate the opening, the bezel comprising a resilient member having a perimeter and two ends, the member being flexible in a direction transverse to the ends of the member when the bezel is inserted in the opening, the member having disposed intermediate the ends thereof at least one recess having a bottom, the recess for securing the edges of the panel therewith when the bezel is inserted in the opening of the panel, the bottom of the recess being positioned to allow for the lateral movement of the bezel in relation to the panel opening transverse to the ends of the member.

5. The insert of claim 4 wherein the resilient member is made from thermoplastic materials.

6. The insert of claim 4 or 5 wherein at least one recess extends about the perimeter of the insert.

7. A bezel for an opening in a vehicle panel, the panel having edges disposed therewith proximate the opening, the bezel comprising a resilient member having a perimeter and two ends, the member being flexible in a direction transverse to ends of the member when the bezel is inserted in the opening of the panel, the member having disposed intermediate the ends thereof at least one recess having a bottom, the recess for securing the edges of the panel therewith when the bezel is inserted in the opening of the panel, the bottom of the recess being positioned to allow for the lateral movement of the bezel in relation to the panel opening transverse to the ends of the member.

8. The bezel of claim 6 wherein the vehicle panel is the outer panel of a vehicle door or trunk lid.

9. The insert of claim 7 wherein the resilient member is made from thermoplastic materials.

10. The bezel of claim 7 wherein the member includes flexing portions disposed intermediate the ends of the member to allow the flexing thereof.

11. The bezel of claim 8 wherein the member includes flexing portions disposed intermediate the ends of the member to allow the flexing thereof.

12. The insert of claim 7 wherein at least one recess extends about the perimeter of the insert.

13. The insert of claim 8 wherein at least one recess extends about the perimeter of the insert.

14. The insert of claim 9 wherein at least one recess extends about the perimeter of the insert.

15. The insert of claim 10 wherein at least one recess extends about the perimeter of the insert.

16. A bezel for an opening in a vehicle panel, the panel having edges disposed therewith proximate the opening, the bezel being installed in the opening of the vehicle panel prior to the panel being installed with a vehicle frame member during the assembly of a vehicle, the vehicle frame member having separately installed therewith a lock portion extending away from the vehicle frame along an axis of extension and to proximate the opening of the panel in use;

the bezel comprising a resilient member having two ends, an axis of extension from end to end of the member and a perimeter, the member having an opening extending therewith along the axis of extension of the member, the opening being surrounded by a border and for receipt of the lock portion when the panel and the vehicle frame are assembled in use, the member having disposed at one end thereof proximate the border of the opening means to align the axis of extension of the opening of the member with the axis of extension of the lock portion when the lock portion is inserted in the opening of the member during assembly of the panel and the vehicle frame, the member being flexible in a direction transverse to ends of the member when the bezel is inserted in the opening of the panel prior to the installation of the panel with the vehicle frame, the member having disposed intermediate the ends thereof at least one recess having a bottom, the recess for securing the edges of the panel therewith when the bezel is inserted in the opening of the panel prior to assembly with the vehicle frame, the bottom of the recess being positioned to allow for the lateral movement of the bezel in relation to the panel opening transverse to the ends of the member when during assembly of the panel and the vehicle frame the lock portion is inserted in the opening of the member and the lock portion engages the means to align the axis of extension of the opening with the axis of extension of the lock portion, whereby upon installation the bezel and lock portion are moveable in relation to one another laterally, and the lock portion is free to move axially in relation to the bezel while maintaining a constant friction fit with the bezel.

17. The bezel of claim 16 wherein the vehicle panel is the outer panel of a vehicle door or trunk lid.

18. The bezel of claim 16 or 17 wherein the vehicle frame is a door frame or a trunk lid frame.

19. The insert of claim 16 or 17 wherein the resilient member is made from thermoplastic materials.

20. The bezel of claim 16 or 17 wherein the member is circular in configuration.

21. The bezel of claim 18 wherein the member is circular in configuration.

22. The bezel of claim 16 or 17 wherein the member includes flexing portions disposed intermediate the ends of the member to allow the flexing thereof.

23. The bezel of claim 18 wherein the member includes flexing portions disposed intermediate the ends of the member to allow the flexing thereof.

24. The bezel of claim 19 wherein the member includes flexing portions disposed intermediate the ends of the member to allow the flexing thereof.

25. The bezel of claim 20 wherein the member includes flexing portions disposed intermediate the ends of the member to allow the flexing thereof.

26. The bezel of claim 21 wherein the member includes flexing portions disposed intermediate the ends of the member to allow the flexing thereof.

27. The bezel of claim 16 or 17 wherein at least one recess extends about the perimeter of the bezel.

28. The bezel of claim 18 wherein at least one recess extends about the perimeter of the bezel.

29. The bezel of claim 19 wherein at least one recess extends about the perimeter of the bezel.

30. The bezel of claim 20 wherein at least one recess extends about the perimeter of the bezel.

31. The bezel of claim 22 wherein at least one recess extends about the perimeter of the bezel.

32. The bezel of claim 17 wherein the means to align the axis of extension of the opening with the axis of extension of the lock portion are tapered surfaces disposed proximate the border of the opening in the member.

33. The bezel of claim 18 wherein the means to align the axis of extension of the opening with the axis of extension of the lock portion are tapered surfaces disposed proximate the border of the opening in the member.

34. The bezel of claim 19 wherein the means to align the axis of extension of the opening with the axis of extension of the lock portion are tapered surfaces disposed proximate the border of the opening in the member.

35. The bezel of claim 19 wherein the means of align the axis of extension of the opening with the axis of extension of the lock portion are tapered surfaces disposed proximate the border of the opening in the member.

36. The bezel of claim 22 wherein the means to align the axis of extension of the opening with the axis of extension of the lock portion are tapered surfaces disposed proximate the border of the opening in the member.

37. The bezel of claim 27 wherein the means to align the axis of extension of the opening with the axis of extension of the lock portion are tapered surfaces disposed proximate the border of the opening in the member.

38. The bezel of claim 17 further comprising tapered portions disposed at on end of the member tapering from proximate the recess towards the end of the member proximate the vehicle frame when assembled, the tapered portions for simplifying the insertion of the member in the opening of the panel until the edges of the opening in the panel are secured in at least one recess of the member.

39. The bezel of claim 38 wherein the end of the member remote the tapered portions includes an arcuate ring portion extending from proximate at least one recess to the end of the member remote the tapered portions.

40. The bezel of claim 39 wherein the arcuate ring portion has an annular lip disposed proximate the panel in use to provide a weather seal for the lock portion, the lip defining a wall of at least one recess, the remaining wall of the recess being defined by the terminus of the tapered portion, the walls defining the recess having a bottom and at least the lip of the arcuate ring portion being biased to engage the edges of the panel proximate the opening thereof.

41. The bezel of claim 40 wherein the lip is biased toward the end of the member wherein the tapered portions are disposed.

42. The bezel of claim 39 wherein the tapered portions of the member are discontinuous and are joined together by flexible webs which enhance the transverse flexibility of the member.

43. A resilient bezel for preinstallation in the opening of a panel of a closure member for a vehicle, the panel having edges disposed therewith proximate the opening, the panel for installation with a frame of a closure member for a vehicle in use, the vehicle closure member frame having disposed therewith a lock portion extending towards the panel opening in use, the bezel comprising a member having two ends, an interior, a first diameter and a perimeter, the member having an opening extending through the interior of the member, some of the opening being bordered by tapering walls having a second diameter proximate one end of the member and tapering towards the opening terminating intermediate the two ends of the member, the opening thereat extending to the end of the member remote the tapered opening and having a third diameter, the tapering disposed proximate the second diameter providing means to align the axis of extension of the opening of the member with the axis of extension of the lock portion when the lock portion is inserted in the opening of the member during assembly of the panel and the vehicle closure member frame, the member being flexible in a direction transverse to ends of the member when the bezel is inserted in the opening of the panel prior to the installation of the panel with the vehicle closure assembly frame, the member having disposed intermediate the ends thereof at least one recess having a bottom, the recess for securing the edges of the panel therewith when the bezel is inserted in the opening of the panel prior to assembly with the vehicle closure assembly frame, the bottom of the recess being positioned to allow for the lateral movement of the bezel in relation to the panel opening transverse to the ends of the member when during assembly of the panel and the vehicle frame the lock portion is inserted in the opening of the member and the lock portion engages the means to align the axis of extension of the opening with the axis of extension of the lock portion, whereby upon installation the bezel and lock portion are moveable in relation to one another laterally, and the lock portion is free to move axially in relation to the bezel while maintaining a constant friction fit with the bezel.

44. The bezel of claim 43 wherein the members includes flexing portions disposed intermediate the ends of the member to allow the flexing thereof.

45. The bezel of claim 43 or 44 wherein the recess extends about the perimeter of the bezel.

46. A method of installing a key cylinder lock preinstalled with the frame of a closure assembly in an opening installed therein, the bezel being moveable in relation to the opening when the panel is installed with the frame to adjust for manufacturing tolerances in the alignment of the key cylinder lock and the bezel, the bezel comprising a resilient member having a perimeter and two ends, the member being flexible in a direction transverse to ends of the member when the bezel is inserted in the opening, the member having disposed intermediate the ends thereof at least one recess having a bottom, the recess for securing the edges of the panel therewith when the bezel is inserted in the opening of the panel, the bottom of the recess being positioned to allow for the lateral movement of the bezel in relation to the panel opening transverse to the ends of the member, the method comprising:

(a) forming a frame for the closure member;
(b) installing the key cylinder lock with the frame oriented laterally away from the frame towards the panel opening in use;
(c) separately forming the exterior panel;
(d) forming an opening thrmugh the exterior panel;
(e) installing the bezel in the opening;
(f) installing the exterior panel with the frame;
(g) wherein when the key lock cylinder is installed in the opening, the bezel moves to adjust for any manufacturing tolerances in the alignment of the key cylinder lock and the bezel, whereby upon installation the bezel and lock portion are moveable in relation to one another laterally, and the lock portion is free to move axially in relation to the bezel while maintaining a constant friction fit with the bezel.

47. The method of claim 46 wherein the vehicle frame is a vehicle door frame.

48. The method of claim 46 or 47 wherein the bezel further comprises a member which is thermoplastic.

49. The method of claim 46 or 47 wherein the bezel further comprises a member wherein the recess extends about the perimeter of the bezel.

50. A method of installing a key cylinder lock preinstalled with the frame of a vehicle closure assembly in an opening through an exterior vehicle panel of the closure assembly having a bezel installed therein, the bezel being moveable in relation to the opening when the panel is installed with the frame to adjust for manufacturing tolerances in the alignment of the key cylinder lock and the bezel, the bezel for an opening in a vehicle panel, the panel having edges disposed therewith proximate the opening, the bezel being installed in the opening of the vehicle panel prior to the panel being installed with a vehicle frame member during the assembly of a vehicle, the vehicle frame member having separately installed therewith a key cylinder lock extending away from the vehicle frame along an axis of extension and to proximate the opening of the panel in use;

the bezel comprising a resilient member having two ends, an axis of extension from end to end of the member and a perimeter, the member having an opening extending therewith along the axis of extension of the member, the opening being surrounded by a border and for receipt of the lock portion when the panel and the vehicle frame are assembled in use, the member having disposed at one end thereof proximate the border of the opening means to align the axis of extension of the opening of the member with the axis of extension of the lock portion when the lock portion is inserted in the opening of the member during assembly of the panel and the vehicle frame, the member being flexible in a direction transverse to ends the member when the bezel is inserted in the opening of the panel prior to the installation of the panel with the vehicle frame, the member having disposed intermediate the ends thereof at least one recess having a bottom, the recess for securing the edges of the panel therewith when the bezel is inserted in the opening of the panel prior to assembly with the vehicle frame, the bottom of the recess being positioned to allow for the lateral movement of the bezel in relation to the panel opening transverse to the ends of the member when during assembly of the panel and the vehicle frame lock portion is inserted in the opening of the member and the lock portion engages the means to align the axis of extension of the opening with the axis of extension of the lock portion, the method comprising:

(a) forming a frame for the closure member;
(b) installing the key cylinder lock with the frame oriented laterally away from the frame towards the panel opening in use;
(c) separately forming the exterior panel;
(d) forming an opening through the exterior panel;
(e) installing the bezel in the opening;
(f) installing the exterior panel with the frame;
(g) wherein when the key lock cylinder is installed in the opening, the bezel moves to adjust for any manufacturing tolerances in the alignment of the key cylinder lock and the bezel, whereby upon installation the bezel and lock portion are moveable in relation to one another laterally, and the lock portion is free to move axially in relation to the bezel while maintaining a constant friction fit with the bezel.

51. The method of claim 50 wherein the vehicle frame is a frame for a door or a deck lid.

52. The method of claim 50 or 51 wherein the panel is the outer panel of a vehicle door or trunk lid.

53. The method of claim 50 or 51 wherein the member of the bezel is thermoplastic.

54. The method of claim 52 wherein the member of the bezel is thermoplastic.

55. The method of claim 54 wherein the member of the bezel is circular in configuration.

56. The method of claim 50 or 51 wherein the member of the bezel includes flexing portions disposed intermediate the ends of the member to allow the flexing thereof.

57. The method of claim 52 wherein the member of the bezel includes flexing portions disposed intermediate the ends of the member to allow the flexing thereof.

58. The method of claim 53 wherein the member of the bezel includes flexing portions disposed intermediate the ends of the member to allow the flexing thereof.

59. The method of claim 50 or 51 wherein the recess of the bezel extends about the perimeter of the bezel.

60. The method of claim 52 wherein the recess of the bezel extends about the perimeter of the bezel.

61. The method of claim 53 wherein the recess of the bezel extends about the perimeter of the bezel.

62. The method of claim 56 wherein the recess of the bezel extends about the perimeter of the bezel.

63. The method of claim 50 or 51 wherein the means to align the axis of extension of the opening with the axis of extension of the lock portion are tapered surfaces disposed proximate the border of the opening in the member.

64. The method of claim 52 wherein the means to align the axis of extension of the opening with the axis of extension of the lock portion are tapered surfaces disposed proximate the border of the opening in the member.

65. The method of claim 53 wherein the means to align the axis of extension of the opening with the axis of extension of the lock portion are tapered surfaces dispose proximate the border of the opening in the member.

66. The method of claim 56 wherein the means to align the axis of extension of the opening with the axis of extension of the lock portion are tapered surfaces disposed proximate the border of the opening in the member.

67. The method of claim 59 wherein the means to align the axis of extension of the opening with the axis of extension of the lock portion are tapered surfaces disposed proximate the border of the opening in the member.

* * * * *